US007780750B2

(12) United States Patent
Carman

(10) Patent No.: US 7,780,750 B2
(45) Date of Patent: Aug. 24, 2010

(54) INTEGRATED BIOMASS CONVERTER SYSTEM

(76) Inventor: Brent Carman, P.O. Box 57, 629 E. Moulton St., Hickman, KY (US) 42050

( * ) Notice: Subject to any disclaimer, the term of this patent is extended or adjusted under 35 U.S.C. 154(b) by 823 days.

(21) Appl. No.: 11/712,178

(22) Filed: Feb. 28, 2007

(65) Prior Publication Data

US 2007/0245934 A1 Oct. 25, 2007

Related U.S. Application Data

(60) Provisional application No. 60/793,567, filed on Apr. 20, 2006.

(51) Int. Cl.

| | |
|---|---|
| ***B01J 7/00*** | (2006.01) |
| ***B01J 10/00*** | (2006.01) |
| ***B01J 10/02*** | (2006.01) |
| ***B01J 12/00*** | (2006.01) |
| ***B01J 19/00*** | (2006.01) |
| ***B01J 19/18*** | (2006.01) |
| ***H01M 8/06*** | (2006.01) |
| ***C01B 3/36*** | (2006.01) |
| ***C10J 3/46*** | (2006.01) |
| ***C10J 3/54*** | (2006.01) |

(52) U.S. Cl. ..... 48/61; 48/197 R; 422/129; 422/224; 422/225

(58) Field of Classification Search ..... 48/61, 48/197 R; 422/129, 224, 225

See application file for complete search history.

(56) References Cited

U.S. PATENT DOCUMENTS 3,841,851 A * 10/1974 Kaiser ..... 48/111
4,428,308 A * 1/1984 Birchfield et al. ..... 110/229
4,583,992 A * 4/1986 Rogers ..... 48/76
4,929,254 A * 5/1990 Kooiman et al. ..... 48/76
5,178,076 A 1/1993 Hand et al.
5,226,927 A * 7/1993 Rundstrom ..... 48/76
5,284,103 A 2/1994 Hand et al.
5,922,092 A 7/1999 Taylor
6,261,090 B1 7/2001 Boswell
6,647,903 B2 11/2003 Ellis
6,808,543 B2 10/2004 Paisley
6,871,603 B2 3/2005 Maxwell
6,960,234 B2 11/2005 Hassett
6,981,455 B2 1/2006 Lefcort
7,007,616 B2 3/2006 Abrams et al.

* cited by examiner

*Primary Examiner*—Alexa D Neckel
*Assistant Examiner*—Matthew J Merkling
(74) *Attorney, Agent, or Firm*—Stephen R. Chapman

(57) ABSTRACT

An integrated biomass converter system capable of converting gasifiable material into a combustible fuel (fuel gas). The system includes elements to convert raw gasifiable material into unprocessed fuel and by a single chamber, down-draft gasifier furnace convert) process) the unprocessed fuel to yield fuel gas. The system includes means to incorporate additional gasifiable materials into the gasifier furnace, or optionally to incorporate material into the unprocessed fuel. The gasifier furnace includes a top closure unit with means to uniformly distribute unprocessed fuel in the furnace and surface treatment means to ensure uniformity of air distribution in the gasification layer and provide means to introduce supplemental gasifiable materials directly into the gasification zone.

7 Claims, 12 Drawing Sheets

INTEGRATED BIOMASS CONVERTER SYSTEM

RELATION TO PRIOR APPLICATIONS

This application claims priority of U.S. Provisional Patent Application No. 60/793,567 filed Apr. 20, 2006, and which Provisional Patent Application is hereby incorporated in its entirety, by reference.

FIELD OF THE INVENTION

This application relates generally to the application of gasification technology for the conversion of biomass to a combustible fuel gas. It combines into one integrated system processing of biomass into a fuel material suitable for conversion in a single chamber, down-draft gasifier furnace into a combustible fuel gas and includes integrated units or elements to introduce oxygen or hydrogen into either the un processed fuel or the combustible fuel gas so as to increase the energy potential of the fuel gas. The invention also integrates optional, simultaneous addition of fine particulate matter to enhance the energy of the resultant combustible fuel gas produced by gasification of biomass based fuel. The invention also relates to recycling waste materials and to the reduction of materials currently disposed of in landfills or otherwise that represent burdens on the environment.

BACKGROUND OF THE INVENTION

The gasification process converts biomass (feedstock) into a synthetic combustible gas primarily comprising carbon monoxide and hydrogen with some methane and other organic gasses. The basic process is relatively simple: the feedstock is exposed to a relative high temperature in an oxygen starved environment such that complete combustion of the feedstock does not occur. The process is not truly combustion in that the feedstock is only partially oxidized to yield the combustible fuel gas. Simple gasification technologies differ, and in view of the present invention, only technology focusing on biomass as a feedstock (to the exclusion of coal and petroleum based materials) are considered, except as rubber may be considered as a source of fine particulate material.

U.S. Pat. No. 5,178,076 issued Jan. 12, 1993 to Hand, et al. and entitled, "Biomass Burner Construction," and U.S. Pat. No. 5,284,103, a division of the '076 patent issued February 8, to hand characterize the basic biomass burner in their specifications. The described burners comprise two "burning chambers," are typically "up-draft for air flow, and place great emphasis on an air flow grate at the base of the first burning chamber and a spent fuel system to remove gasification by products.

U.S. Pat. No. 5,922,092 issued Jul. 13, 1999 to Taylor discloses a bottom feed, up-draft gasification system. The system comprises four major elements: a thermal reactor similar in function to the '076 and '103 patents, within fuel gas conveyed to a mechanical cleaner, thence to a cooler, and finally to an electrostatic precipitator. With respect to prior art, the system of the '092 patent overcomes in part certain problems of cleaning and cooling the fuel gas produced.

In U.S. Pat. No. 6,647,903 issued Nov. 3, 2003, discloses both a process to produce by gasification a combustible fuel gas with reduced tar content and a device (gasifier) specifically adapted for application of the described method. The device depends on specific internal geometry and on specific points of introducing air to control processing temperature, thereby controlling tar production and accumulation.

U.S. Pat. No. 6,808,543 issued Oct. 26, 2004 to Paisley reflects improvements in a alternative type of gasifier. The '543 patent discloses and claims both improved methods and an apparatus for operating a parallel entrainment fluidized bed gasifier system. The improvement involved addition of MgO to biomass to reduce agglomeration and a device to facilitate the flow of sand and char between gasifier compartments and minimize the flow of gasses between the compartments. Sand is used as the medium of heat exchange.

U.S. Pat. No. 6,871,603 issued Mar. 29, 2005 to Maxwel includes a plurality of claims for a gasifier system. The system comprises, generally, a gasifier, a site for preparing biomass for gasification, a boiler for combusting fuel from the gasifier to produce "useful energy," and air delivery system to serve the gasifier, and a fan system to maintain the boiler and gasifier under negative pressure. The preparation site presses excess moisture from the biomass and utilizes air drying for additional moisture reduction. The gasifier is a bottom fed, up-draft facility with a blower to deliver air to intake inlets with dampers to control air flow. Combustible fuel is conveyed from the gasifier to the boiler where it is mixed with air and combusted to yield useful energy.

In U.S. Pat. No. 6,960,234 issued Nov. 1, 2005, Hassett discloses and claims in detail a multifaceted gasifier and related method. The gasifier is designed with a fixed-bed gasification element for processing relatively coarse biomass fuel material and an entrained gasification element wherein pulverized, liquid or solid, or gaseous biomass materials are processed to yield a combustible fuel gas produced by gasification driven by the fixed bed gasification element.

U.S. Pat. No. 6,981,455 issued Jan. 3, 2006 to Lefcort embodies technology to convert wet biomass to a useful, combustible fuel, utilizing a two-stage wet gasifier. The first stage gasifier chamber comprises sets of vertical and horizontally aligned bars to (i) support the waste material to be gasified and remove by-product ash and (ii) supply combustion air.

U.S. Pat. No. 7,007,616 issued Mar. 7, 2006 to Abrams and Cuilvey describes and claims a biomass gasifier system wherein biomass is conveyed to a gasifier chamber via fire belts, and oxygen input is metered along the length of each belt to control the temperature in the gasification chamber. Carbon dioxide is introduced as an oxygen diluent for the input oxygen. Oxygen is separated from ambient air by a (pressure) air separation unit. The combustible fuel gas produced by the gasification process is combusted in association with a boiler to produce useful energy.

Many process that combust a variety of materials, including biomass, yield by-products that are recognized as significant air pollutants, including as is widely recognized, particulate matter that comprises a significant part of smoke. Many of these particulate materials also have the potential to yield useful, combustible fuel when gasified. In U.S. Pat. No. 6,261,090 issued Jul. 17, 2001, Bosewell et al. describe and claim technology uniquely directed to the gasification of smoke, or combustion by-products.

Thus, there remains room for improvement in integrated biomass converter systems related to converting raw biomass material to yield an unprocessed fuel that can be gasified to yield a combustible fuel gas and systems wherein the energy potential of the biomass fuel can be adjusted by introduction of hydrogen and/or oxygen with or without simultaneous introduction of fine particulate matter and also by the addition of other, specific types of organic and inorganic wastes, and further wherein the energy potential of the combustible fuel can be adjusted by the addition of hydrogen or oxygen.

SUMMARY OF THE INVENTION

A primary purpose of the invention is an integrated biomass converter system capable of transforming raw biomass material into an unprocessed fuel and of converting the unprocessed fuel into a combustible fuel gas. An additional purpose of the invention is means by which fine particulate material or gasifiable material can introduced into a single chamber, down-draft gasifier furnace for conversion into a combustible fuel gas. A still further purpose of the invention is the controlled introduction of oxygen or hydrogen gas into the gasifier to optimize the gasification process, or into the combustible fuel gas to increase the energy potential of the fuel gas. A still further purpose of the invention is a device to control the distribution of the unprocessed fuel in the gasifier's chamber and to allow the introduction of oxygen or hydrogen to specific layers of fuel within the gasifier chamber.

These and other purposes and goals are achieved by an integrated biomass converter system capable of separating gasifiable material from non-gasifiable material, of processing the gasifiable material—generally biomass—to a fuel pulp and converting the fuel pulp to unprocessed fuel, to be gasified in a single chamber, down-draft gasifier furnace; the system includes five major, functional elements or units: an initial processing unit in which materials are separated and biomass is chopped and macerated to yield a fuel pulp (also in this stage other gasifiable material may be added to the fuel pulp); a final processing unit in which fuel pulp through an extrusion-like process is converted to unprocessed fuel; the unprocessed fuel is converted to a combustible fuel gas through the process of gasification in the single chamber, down-draft gasifier furnace; the manner in which the furnace is initially loaded with a charcoal base (or spent fuel) and the shape of the upper and lower body of the gasifier furnace, including the formation of a shoulder region at the interface of these two body parts, creates a fuel gas accumulation zone in the furnace; as a result of gasification process, the fuel gas is hot and must be cooled; it is discharged from the from the fuel gas accumulation zone to a cooler where heat is dissipated and where additional combustible gasses may be added to the combustible fuel gas; from the cooler, the combustible fuel gas is conveyed to a dryer and is dried; this step completes the gasification process; the combustible fuel gas is transferred a storage facility; in addition to the above major functional elements, the system includes a first conveyor that transfers the gasifiable material from an initial storage site to the initial processing unit, a second conveyor that moves the fuel pulp from the initial processing unit to the final processing unit, and a third conveyor that transfers unprocessed fuel to a temporary storage location; a closed auger moves the unprocessed fuel from the temporary storage location to the fuel input unit of the gasifier furnace; input of unprocessed fuel, oxygen availability in the gasification zone, and removal of spent fuel from the gasifier furnace are carefully monitored and controlled and balanced to establish and maintain required conditions in the gasification zone in the furnace; a down-draft air flow gradient is established and maintained by an air pump positioned on the top closure of the furnace; that pump and other in-line pumps in the fuel gas output from the gasifier furnace through the cooler and dryer to the storage point combine to ensure maintenance of down-draft conditions, and the air pump positioned on the top closure controls the rate and quantity of air moving into the gasifier furnace; in addition to the air pump and fuel input unit, the top closure element supports an exhaust gas vent that, by high temperature treatment effectively destroys particulate matter (potential air pollutants) produced as a product of initial (cold start) operation of the system; the top closure/cap piece supports the primary fuel distribution element that includes a support and distribution sphere that is anchored in the center of the center piece; a hollow central axle passes through the sphere, and at the top, the supplemental fuel and gas input pipe is connected to the central axle; at the bottom, a surface treatment element is connected to the distil end of the central axle by a sequence of hollow connecting parts terminating in gas injection shoes, material entering the supplemental fuel and gas input pipe are uniformly distributed in the surface of the upper most layer of unprocessed fuel in the furnace; a system of press-wheels also connected to the distil end of the central axle smooths and conditions the surface of the unprocessed fuel; the system of press wheels rotates on an axle and the wheels and axle are supported by a frame that is attached to the distil end of the central axle; in addition, platform supports are secured to the sphere and descend from it to function as the supports for rotational and travel gear elements of the rotational and travel gear system that allows the central axle and connected shoes and press wheels to move vertically and rotate on and slightly below the surface of the unprocessed fuel in the gasifier furnace; finally, the integrated biomass converter system includes a separate incinerator unit adapted to produce gasifiable particulate matter in the form of heavy smoke from burning certain gasifiable materials; the particulate matter (smoke) can be introduced to the fuel pulp as it is chopped to become part of the unprocessed fuel or directly to the gasifier furnace by means of the supplemental gas and fuel input pipe.

These and other purposes and goals of the invention will be more clearly and fully comprehended and appreciated by examination of the following figures, specification including description and examples, and appended claims.

DESCRIPTION OF THE INVENTION

Underlying Technology

Figure 1:
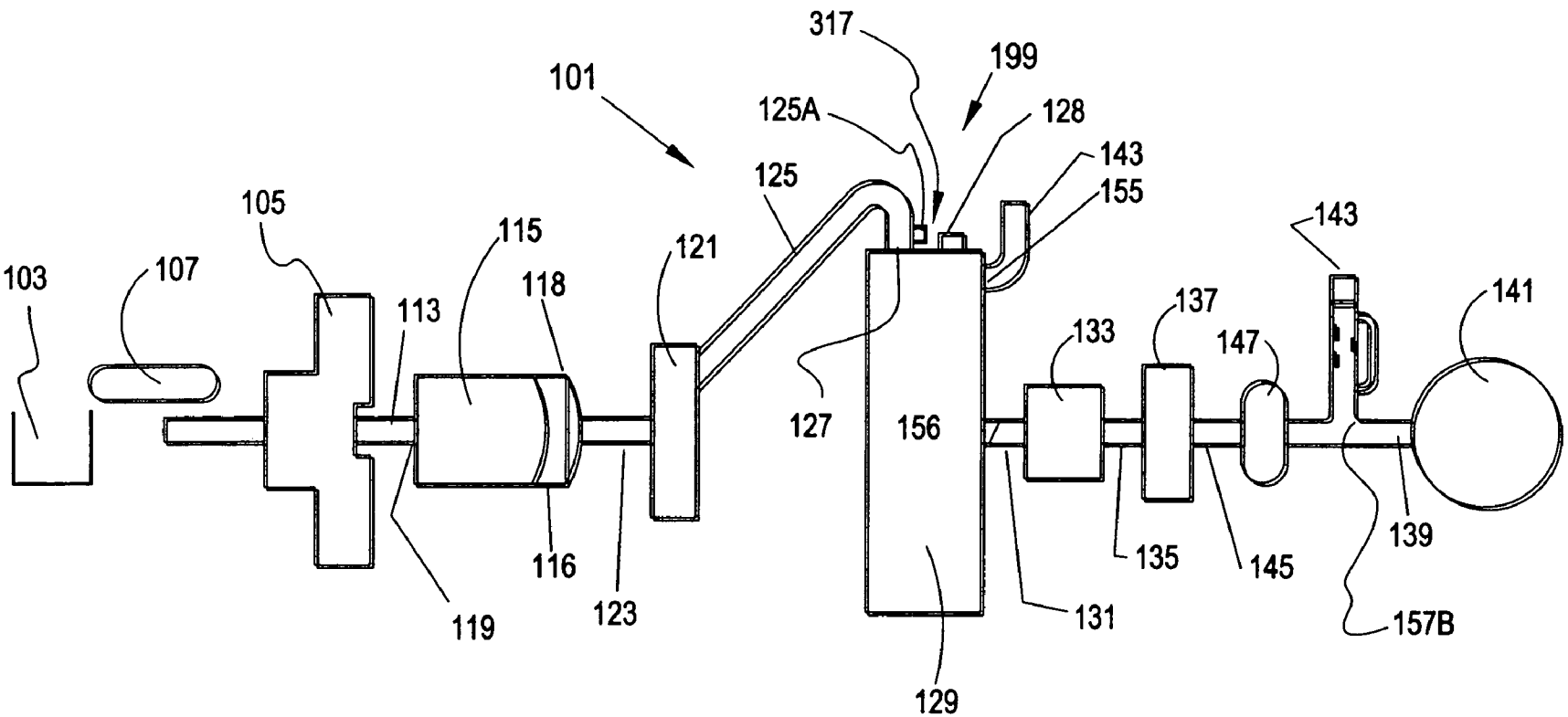
FIG. 1 Schematic of integrated gasifier system.

Understanding the basic process of gasification is fundamental to understanding the invention. Gasification is a controlled process of incomplete combustion in which unprocessed fuel is maintained in one of several layers at a relatively high temperature with inadequate available oxygen for complete combustion such that a combustible fuel gas is continually produced as a product of the incomplete combustion. Successful gasification requires a fuel material, most commonly a form of biomass or other organic (carbon based) material (unprocessed fuel), a furnace device capable of sustaining a thermally defined gasification zone and an air circulation system capable of maintaining a constant condition of oxygen exhaustion at the lower limit of the gasification zone.

The Gasification Furnace

In an integrated biomass converter system, a single chamber, down-draft, gasification furnace is functionally the key component, FIGS. 3 A,B,C. The interior chamber of a single chamber, down-draft gasification furnace is divided vertically into three regions or layers, based on the fuel material comprising the layer, operating temperature in the layer or region, and availability of air (oxygen). The bottom region or lower most layer 311 comprises spent fuel, the by-product of gasification of the unprocessed fuel. This layer is devoid of oxygen, and the hot spent fuel is slowly cooling in the absence of oxygen. The middle region or layer 307 is the pyrolysis layer in which active gasification process occur in a narrow middle zone, the gasification zone 309, of the middle (pyrolysis) layer 307. Temperatures are controlled in this zone, oxygen is available at the upper limit of the region and fully depleted at its lower limit. The uppermost region or layer 305 comprises a uniform layer of unprocessed fuel. Oxygen is available throughout this layer, and the temperature is below the combustion point of the unprocessed fuel.

By controlling the temperature of the unprocessed fuel within defined layers in the furnace, fuel gas is driven off in a thermally defined gasification zone of the combustion or pyrolysis region, and by various design features or devices it is accumulated and collected. The gasification process depends on high temperature and incomplete combustion of the unprocessed fuel. Incomplete combustion is accomplished by controlling the quantity of unprocessed fuel in the gasification zone at any time and controlling oxygen (air) availability to ensure that oxygen is fully depleted in the gasification zone as the lower-most portion of the unprocessed fuel material in the gasification zone is fully gasified.

Maintaining optimum gasification conditions requires precise balancing of the removal of spent fuel from the bottom of the furnace device with the addition of unprocessed fuel to ensure oxygen depletion at the lowest limit of the gasification region and maintaining constant and uniform conditions for each of the three thermally defined zones. In addition to maintaining a level, uniformly thick layer of unprocessed fuel, maintaining the surface of that layer free of crusts and conditions that might differentially affect the flow of air into the furnace is of significant importance, particularly in a single chamber, down-draft gasification furnace such as that of the present invention.

Although the single chamber, down-draft gasifier furnace is a key element of the integrated gasification system, the role and significance of other elements cannot be minimized. The integrated biomass conversion system includes means to process raw biomass to yield gasifiable, unprocessed fuel, the furnace element, and associated with the furnace element, means to process the fuel gas produced, including cooling and drying it. The system may also include means to produce and introduce gasifiable, particulate matter into the gasifier furnace as well as means to introduce additional materials into the unprocessed fuel or to the gasification process.

Structure and Functions of the Integrated Biomass Converter System

The elements of an integrated biomass converter system and their structural and functional relationships are best explained in reference to FIGS. 1 through 6. In many instances the same part may be appear in more than one figure. In such instances, the reference number assigned in the initial discussion and reference is carried to all other figures, although generally the initial discussion of the part, unit, or element is not repeated.

As diagramed in FIG. 1, the integrated biomass converter system 101 comprises five linearly connected elements that are central to the function of the system: an initial separating and processing element 105, a final processing element 115, a single chamber, down-draft gasifier furnace 129, a cooler 133, and a dryer 137. The initial storage unit 103, temporary storage unit 121, and final storage unit 141 are sequentially functional and cannot be ignored; the various biomass conveying and unprocessed fuel transferring elements are similarly sequentially functional and cannot be ignored. As one skilled in the art understands, the structures and functions of the storage units and conveying and transferring fuel gas elements may be satisfied in a variety of manners which are anticipated by the invention.

The size and physical shape and properties of the storage unit 103 may vary as a function of the type of raw biomass to be stored (for example, but not as limitations, woody plant material, agricultural plant materials, such a straw, fruit and vegetable processing waste, certain animal processing by-products, and landfill minings) and the location. In some instances the storage unit 103 may be a concrete slab on which material is piled; it may be a pit or a hopper structure. A first conveyor 107, most commonly an open belt conveyor, moves the raw biomass from the storage unit 103 it to an initial separating and processing unit 105.

The initial separating and processing unit 105 is adapted to a variety of functions depending on the characteristics of the raw biomass. At a minimum, metal is removed, non-gasifiable debris is screened out, and the raw biomass is rolled, crushed and chopped to yield a fuel pulp. The fuel pulp is conveyed by a second conveyor 113 to the final processing unit 115 at entry point 119. The final processing unit 115 comprises a screw, pump, or comparable extruder system by which the fuel pulp is passed through a die plate to form unprocessed fuel (commonly pellets). Prior to transfer from the final processing unit 115 to temporary storage 121 by means of a third conveyor 123, the unprocessed fuel is dried at ambient temperature in a rotating drum 116 or comparable device positioned as part of the distil end 118 of the final processing unit 115. In one configuration, heated, forced air is used to facilitate drying in the rotating drum 116, and in another, the rotating drum 116 is heated.

From the temporary storage 121, the unprocessed fuel is transferred by a closed auger 125 to a fuel input unit 127 in the single chamber, down-draft, gasifier furnace 129. An air input pump 128 is positioned to force air into the gasifier furnace from the top element 317, thereby creating and maintaining down draft conditions when the gasifier furnace reaches a minimum operating temperature (approximately 800 C). Initially, up draft conditions exist to direct initial exhaust fumes (start-up exhaust) through the exhaust discharge vent 143.

The closed auger 125 or fuel input unit 127 may include a vacuum device 125A for dust control as described below.

The directional gradient generated by the air input pump 128 is supplemented by the gradient generated by the directional flow of fuel gas from the single chamber, down-draft gasifier furnace 129 and conveyed by the first fuel gas discharge pipe 131 to the cooler 133 and then from the cooler 133 to a dryer 137 by second fuel discharge pipe 135. From the dryer, the fuel gas is conveyed by dryer discharge pipe 145 to an in-line pump 147 and from the in-line pump 147 by final fuel discharge pipe 139 to a fuel gas storage element 141. The in-line pump 147 further serves to maintain the down-draft, directional gradient of flow of air and fuel gas from the single chamber, down-draft gasifier furnace 129 to the fuel gas storage element 141.

The single chamber, down-draft gasifier furnace 129 in combination with the closed auger 125 and the first fuel gas discharge pipe 131, second fuel gas discharge pipe 135, and final fuel gas discharge pipe 139 and in-line pump 147 is a closed system in that air can only enter via air input pump 128.

In one example, the exhaust discharge vent 143 may be positioned in-line between the in-line pump 147 and fuel gas storage element 141. Preferably, the exhaust discharge vent is positioned on the top element 317.

General Descriptions

The individual units, elements, and parts of the integrated biomass converter system 101 differ in complexity and are described with appropriate detail in the following paragraphs. The three conveyor belts, 107, 113, and 123, transfer the initial biomass material in different stages of processing into unprocessed fuel between different elements of the system as described above. Functionally, each is described or illustrated as an open belt-type of conveyor of appropriate size for the anticipated capacity of the unit and space (distance) between units. The invention anticipates other forms and types of conveyors. The closed auger 125 is a closed element to avoid adverse air flow and disrupt the down-draft air flow as unprocessed fuel is discharged into the single chamber, down-draft, gasifier furnace 129 in which down-draft conditions are maintained for gasification of the unprocessed fuel.

The various discharge pipes, 131, 135, 145, 149, and 139, (and unillustrated related fittings) are structurally comparable with functions as described. Generally they are fabricated from commercial stock suitable for high temperature operations as on skilled in the art understands. Length is variable, as a function of distances between connected units or elements. Inside diameter is a matter of practical convenience, with 0.5 inch (1.27 cm) a practical minimum and 4.00 inch (10 cm) a practical, but not limiting maximum.

Starting with introducing the unprocessed fuel at fuel input unit 127, the single chamber, down-draft, gasifier furnace 129 (or system from that point forward) is a closed, down-draft fuel gas generator. The initial air flow gradient or air flow differential is generated by the air input pump 128. The volume (amount) of air flowing into the system is controlled to ensure that oxygen is fully depleted in the gasification zone 309 and a high temperature sustained without complete combustion of the unprocessed fuel. Air pressure of from 0.1 to 25 psi and air flow of 1.0 to 100 $ft^3$/sec are reasonable, but not absolute limits.

The initial processing unit 105 is the first, functional unit in the integrated biomass converter system 101. FIG. 2 illustrates the initial processing unit 105 with a plurality of functional elements, some of which may be by-passed depending on the specific type and condition of raw biomass to be processed.

Biomass is transported from the storage unit 103 by the first conveyor 107 to a discharge point 109 to the biomass input point 201 of the initially processing unit 105. The initial processing unit 105 comprises a slotted, shaker/vibrator surface 203 that slopes downward from the biomass input point 201 to the front edge 231 of the crusher element 213. Vigorous, continuous shaking of the surface is caused by rotation of the off-set wheels 209 connected by support arms 207 to the surface 203. The off-set wheels 209 are mounted on base supports 233. Debris is shaken from the biomass material and falls through the slots on the surface 203 to a collection point (not illustrated). Metallic debris is removed by passing the raw biomass under a magnetic arm 205 positioned near the lower end of the surface 203, or otherwise through a magnetic field as one skilled in the art would understand.

Figure 2A:
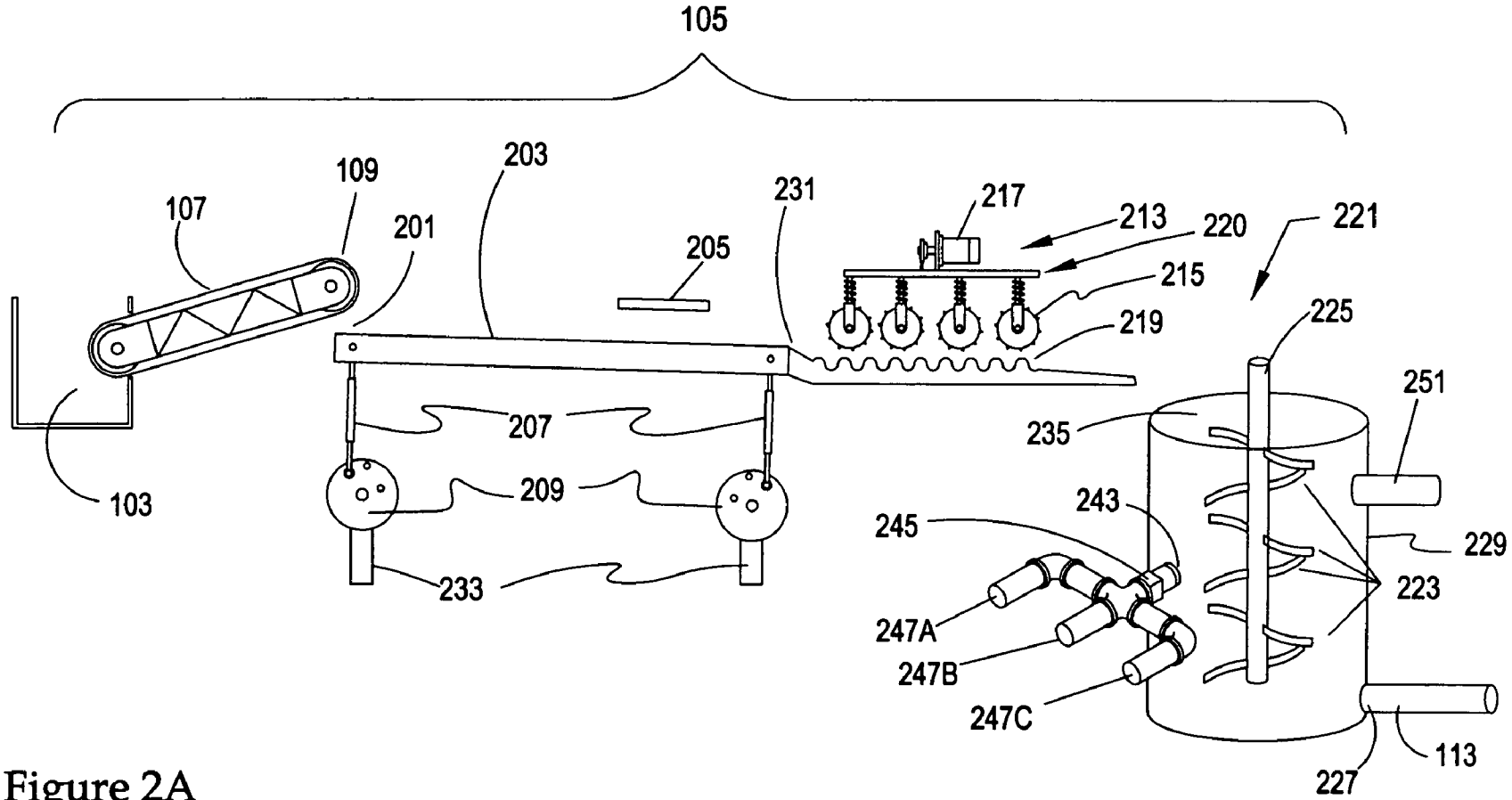
FIG. 2A Diagram of initial separation and processing element.

The raw biomass is moved by gravity and force of the shaker action, plus manual assistance (by an attendant) to the crusher element 213. The crusher element 213 comprises two fundamental parts: one or more rotating, corrugated cylinders 215 with a power source 217 and a corrugated surface 219. The diameter of the corrugated cylinders 215 varies from less than 4 inches (10 cm) to over 36 inches (3 m) and the length from 3 feet (1 m) to over 9 feet (3 m) Neither the diameter nor the length of the cylinders is limiting; the length is generally approximately equal to the width of the corrugated surface 219. The corrugated cylinders 215 are mounted on a frame 220 such that they can be raised or lowered with respect to contact with the corrugated surface 219 and there by exert pressure on materials passing between them and the corrugated surface 219, thereby crushing, tearing, and shredding the raw biomass. Weight of the individual corrugated cylinders varies and ranges from a few hundred pounds to one or more tons, depending on the material to be crushed. A practical, but not limiting range is 500 to 1500 pounds (227 to 682 kg). As illustrated in FIG. 2A, the corrugated cylinders 215 rotate in a counter-clockwise direction, thereby moving crushed and shredded biomass material towards to the chopper element 221.

The chopper element 221 comprises a chopper housing 229 with a bowl-like interior 235 into which the crushed and shredded raw biomass is discharged by the crusher element 213. A plurality of heavy-duty blades 223 are mount on a rotating central axis 225 that is powered by a separate motor (not illustrated). The rotating blades 223 further chop and shred the raw biomass to produce fuel pulp material. To allow control of the texture of the fuel pulp material, the chopper element includes pipe means 251 by which water and appropriate binder materials may be added to the fuel pulp. In addition, the chopper element 221 includes a supplementary fuel material delivery pipe 243 with an in-line supplementary fuel material delivery pump 245 into which one or more supplementary fuel supply lines 247A, B, and C deliver gasifiable material, such as but not limited to vegetable oil, petroleum products, and liquified organic wastes including animal fats to be incorporated into the fuel pulp material. The fuel pulp material is discharged at the bottom discharge point of the chopper housing 229 at a discharge point 227 through second conveyor 113 and transported to the final processing unit 115.

The chopper element 221 performs two functions: shredding, tearing, and chopping the biomass material into a pulverized, semi-liquid fuel pulp and homogenizing the fuel pulp by incorporating water and binders and by mixing and blending supplemental fuel materials added to the fuel pulp material, including mixing materials that affect the gasification process (combustion) of unprocessed fuel, not the yield of fuel gas directly. In an alternative best mode, supplemental fuel material may be added directly to the single chamber, down-draft, gasifier furnace 129 and not incorporated in the unprocessed fuel.

Figure 3A:
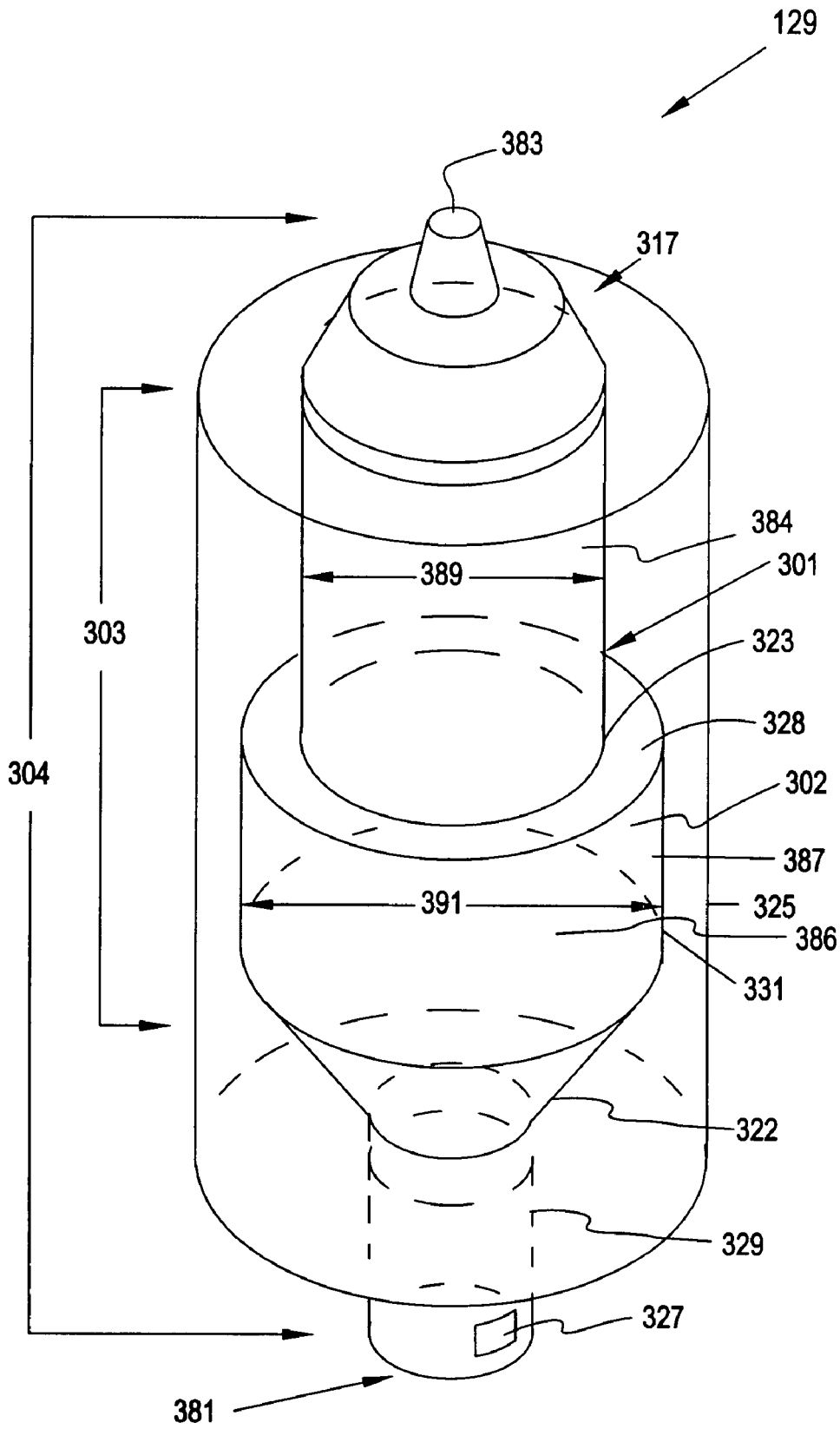
FIG. 3A Cross-section diagram of single chamber, down-draft gasification furnace showing structural parts and relationships.
Figure 3B:
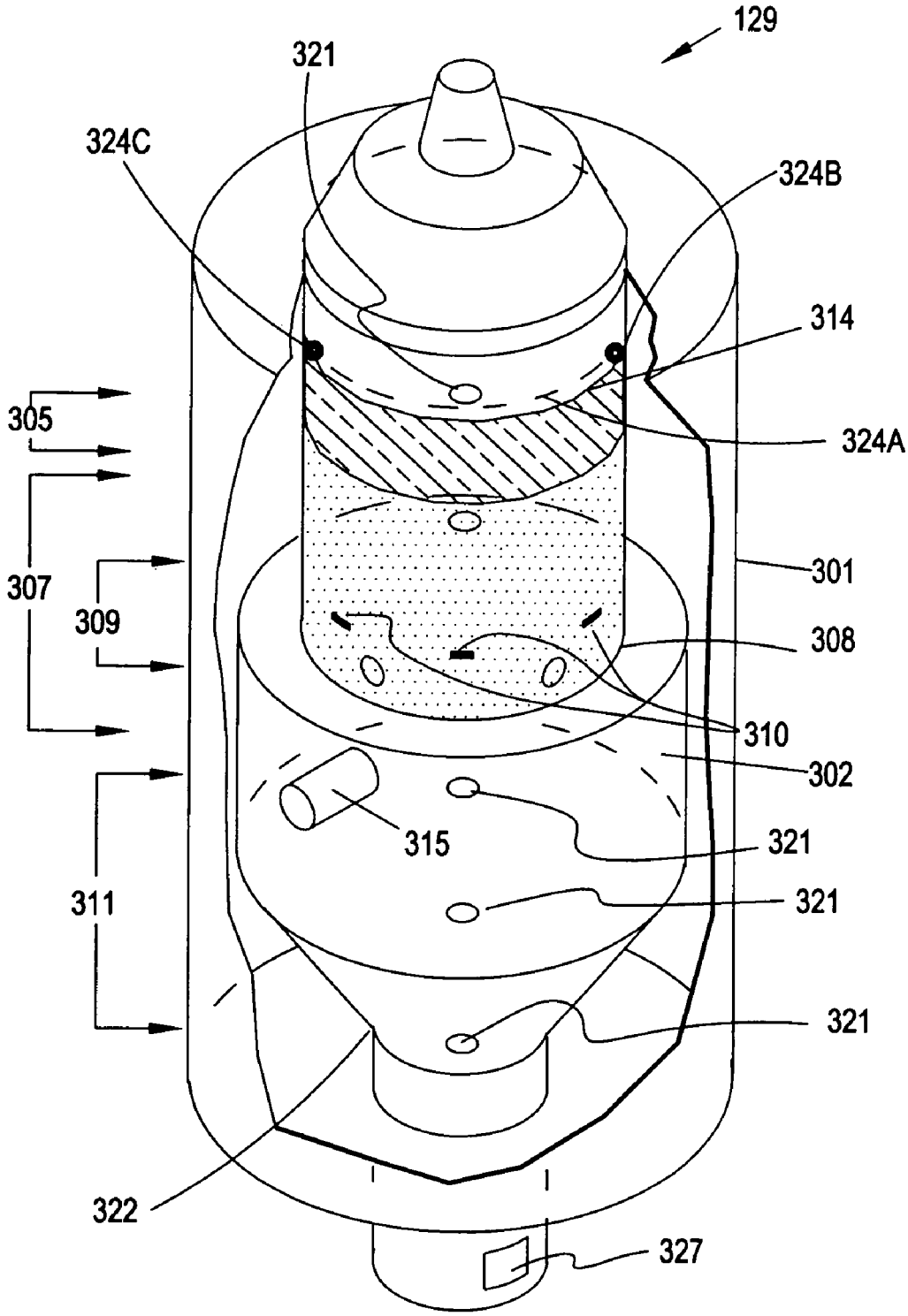
FIG. 3B Cross-section diagram of single chamber, down-draft gasifier furnace showing various thermal regions and certain process controls.
Figure 3C:
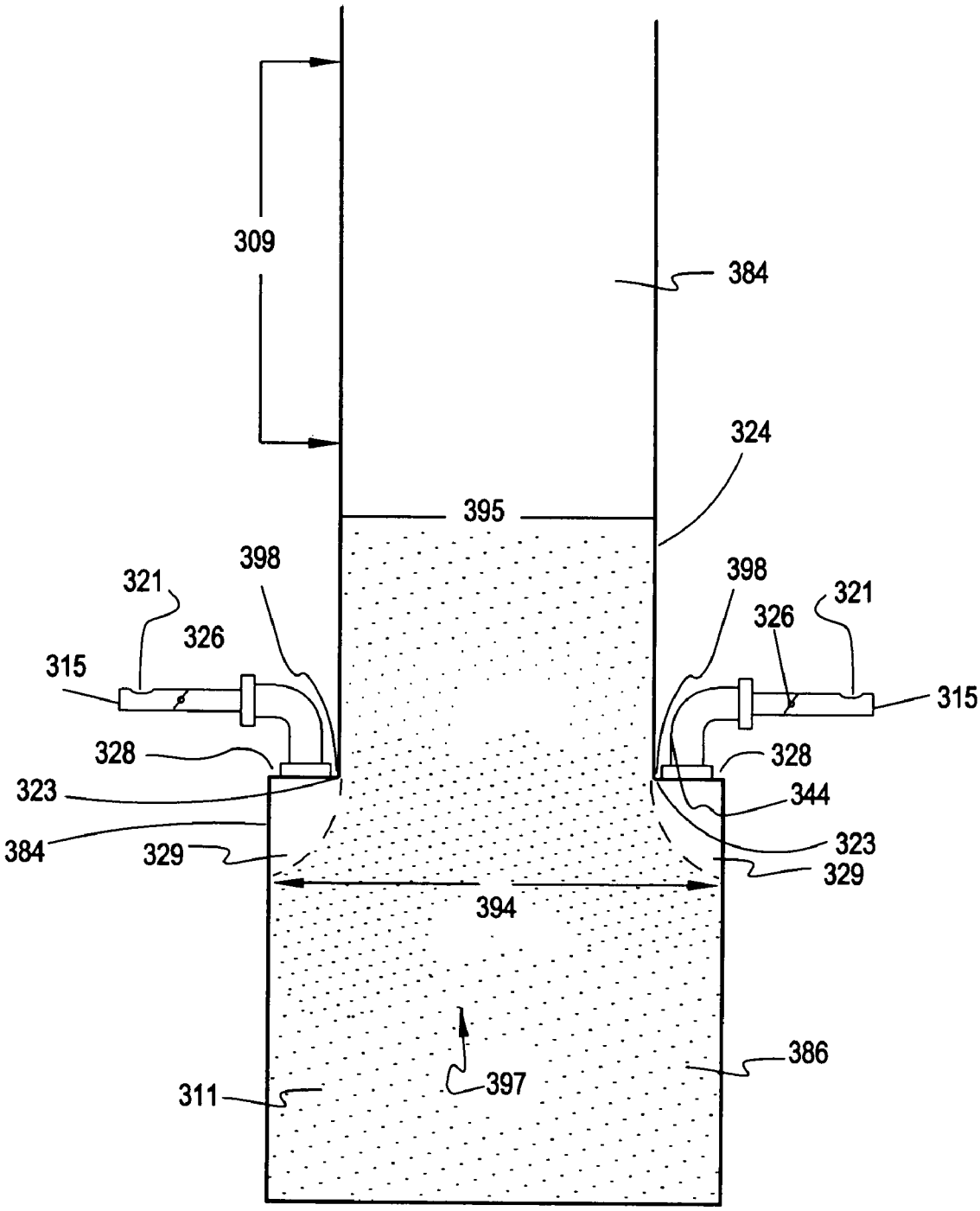
FIG. 3C Cross-section diagram of single chamber, down-draft gasifier furnace showing initial loading details.
Figure 3D:
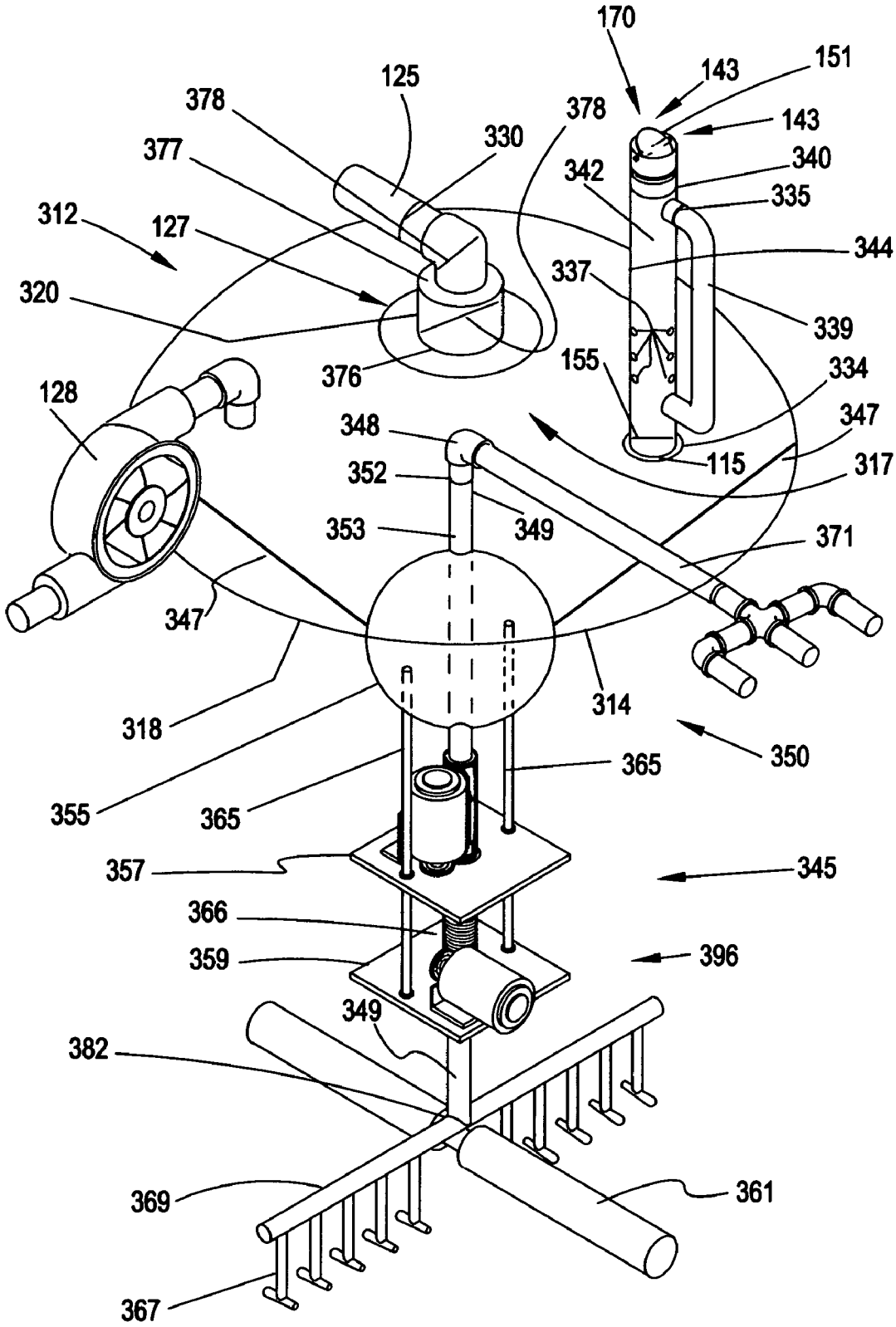
FIG. 3D Diagram of top closure element and surface treatment element.
Figure 3E:
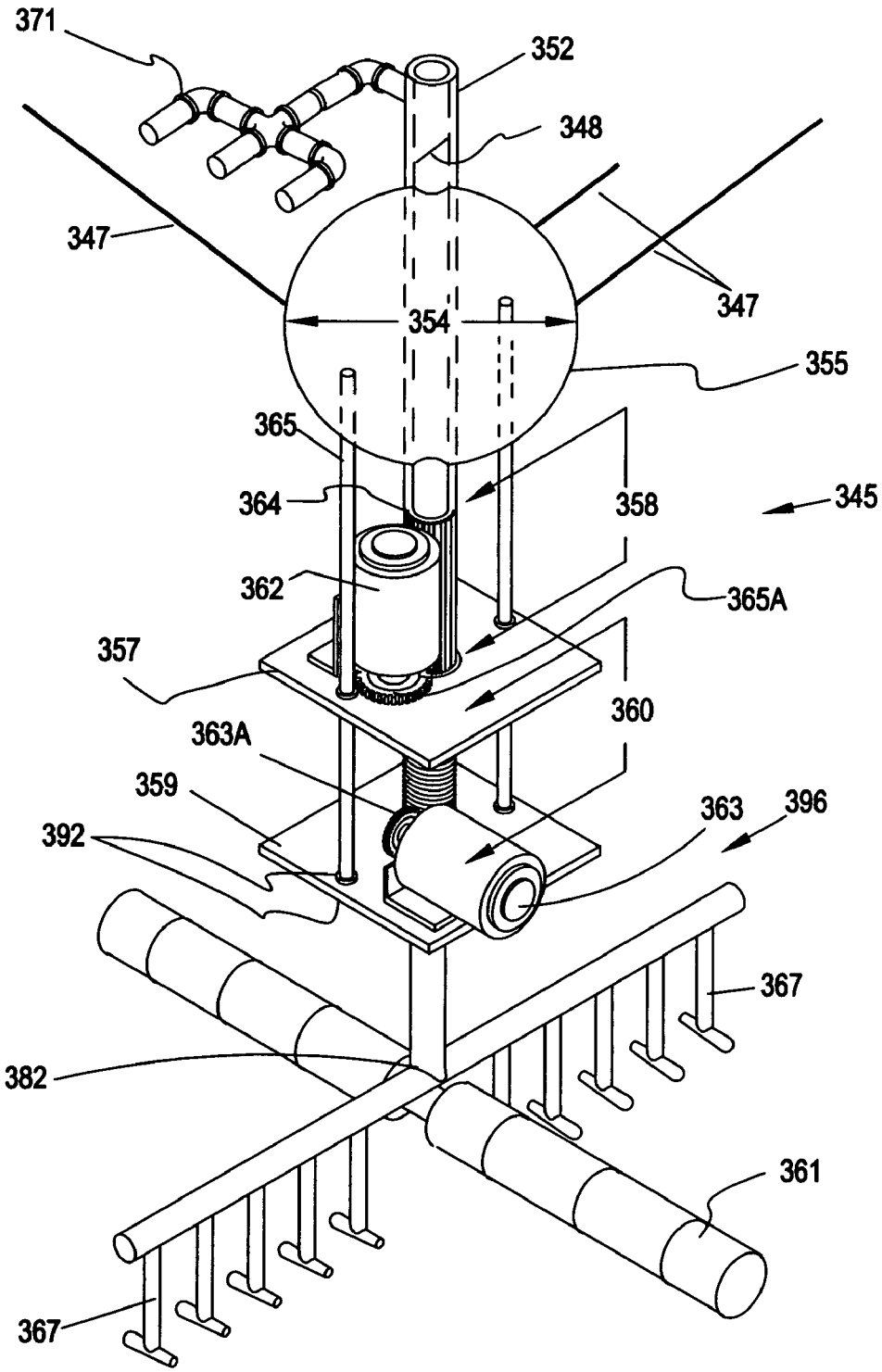
FIG. 3E Structural details of controls of movement of surface treatment element.
Figure 3F:
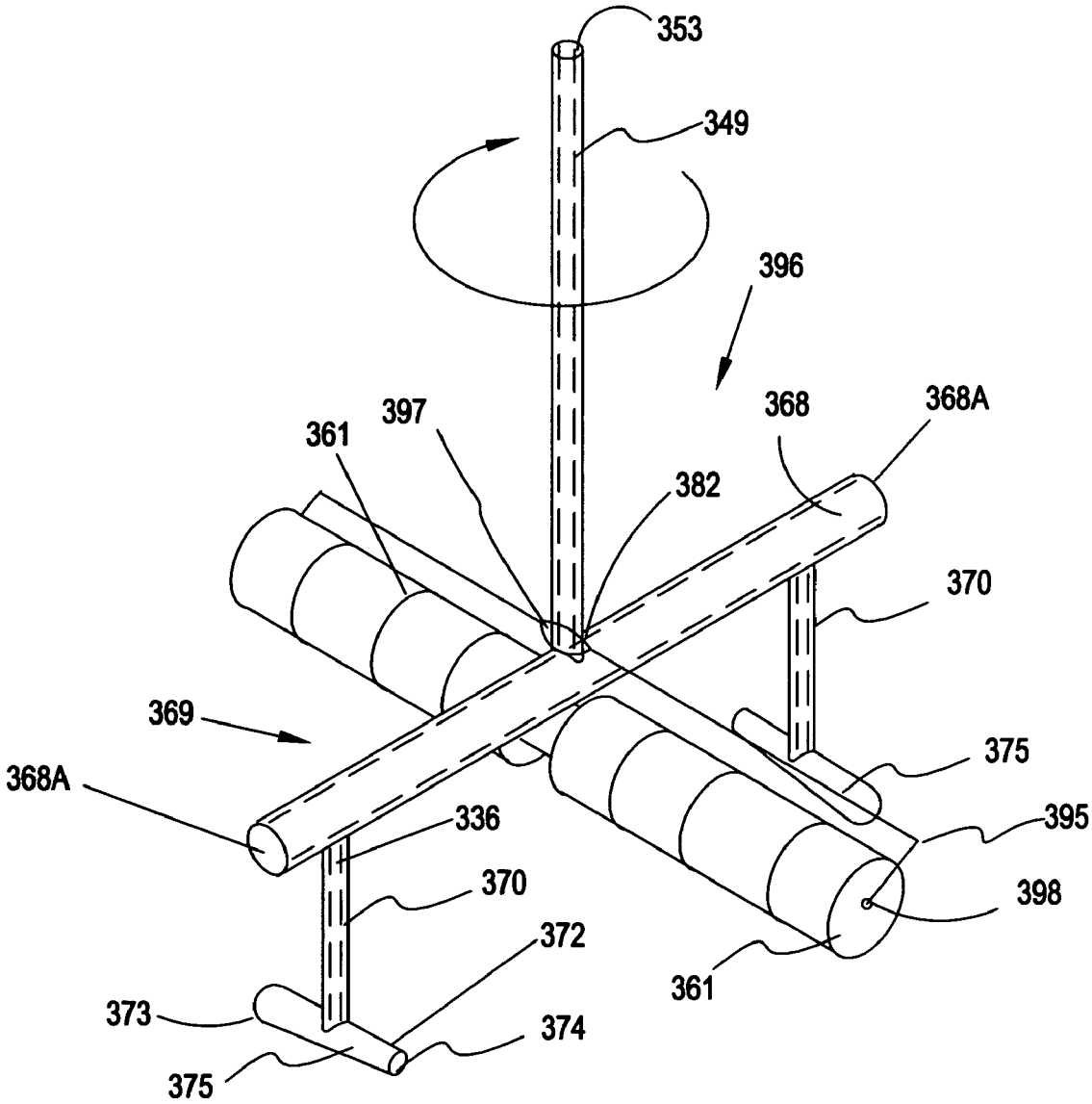
FIG. 3F Structural details of means to introduce supplemental fuel by surface treatment element.
Figure 4:
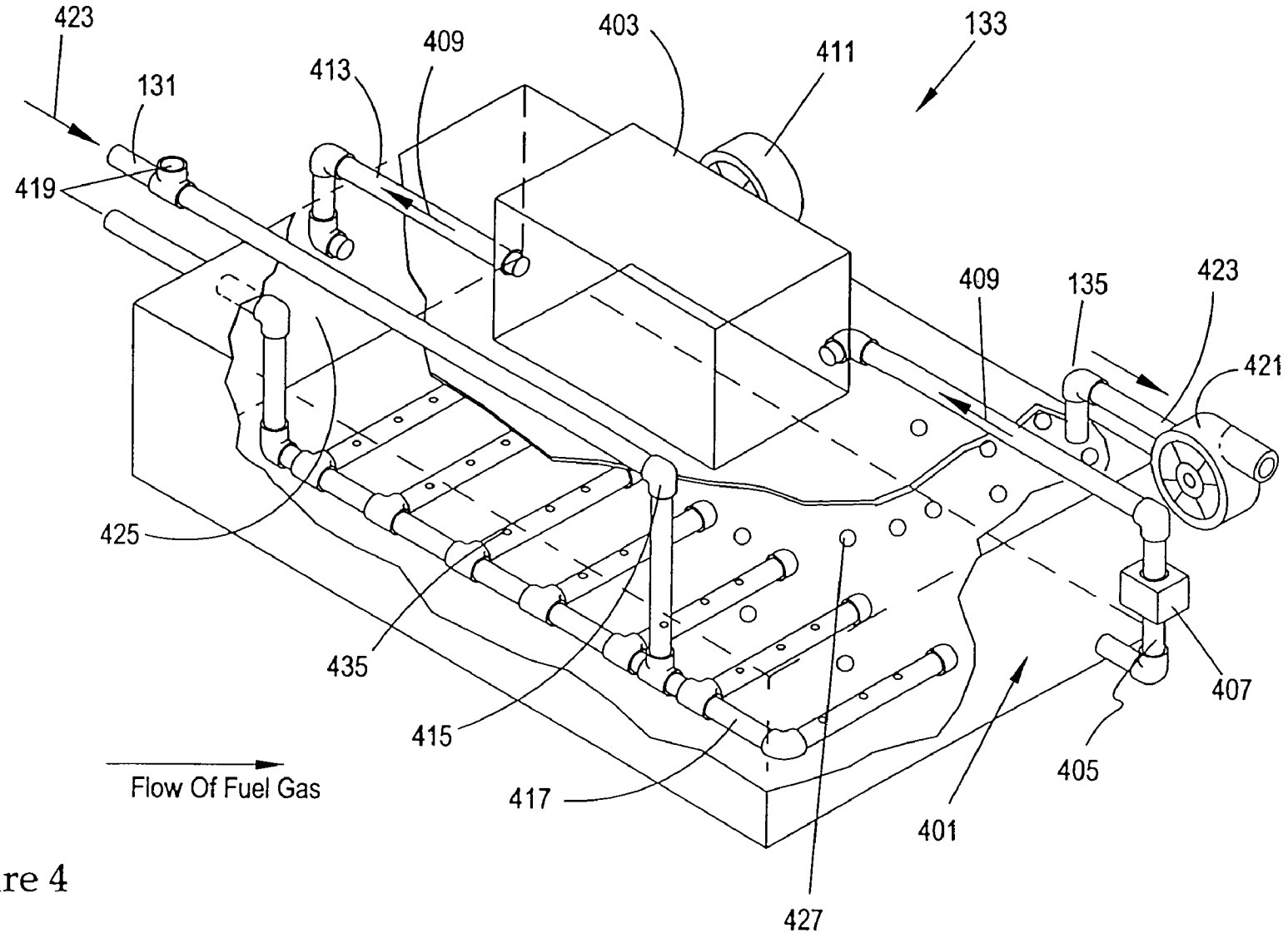
FIG. 4 Diagram of fuel gas cooler.

Supplemental fuel material in the form of liquids or fine particulate matter (such as, but not limited to vegetable oil, petroleum products, liquified animal waste, incomplete combustion products of gasifiable material (such as smoke from incomplete burning of rubber tires) can be introduced to the layer of unprocessed fuel (upper most layer 305) by means of supplemental fuel injection element 371 as it is functionally and physically connected with the unprocessed fuel management element 396 FIGS. 3D-F. In addition, other gasifier reactants, including, but not limited to oxygen, hydrogen, methane and other carbon containing gasses, can be introduced to the upper most layer 305 through the supplemental fuel injection element 371, and by down draft forces transported to the gasification zone 309 to be gasified or otherwise affect the gasification conditions and process.

Figure 2B:
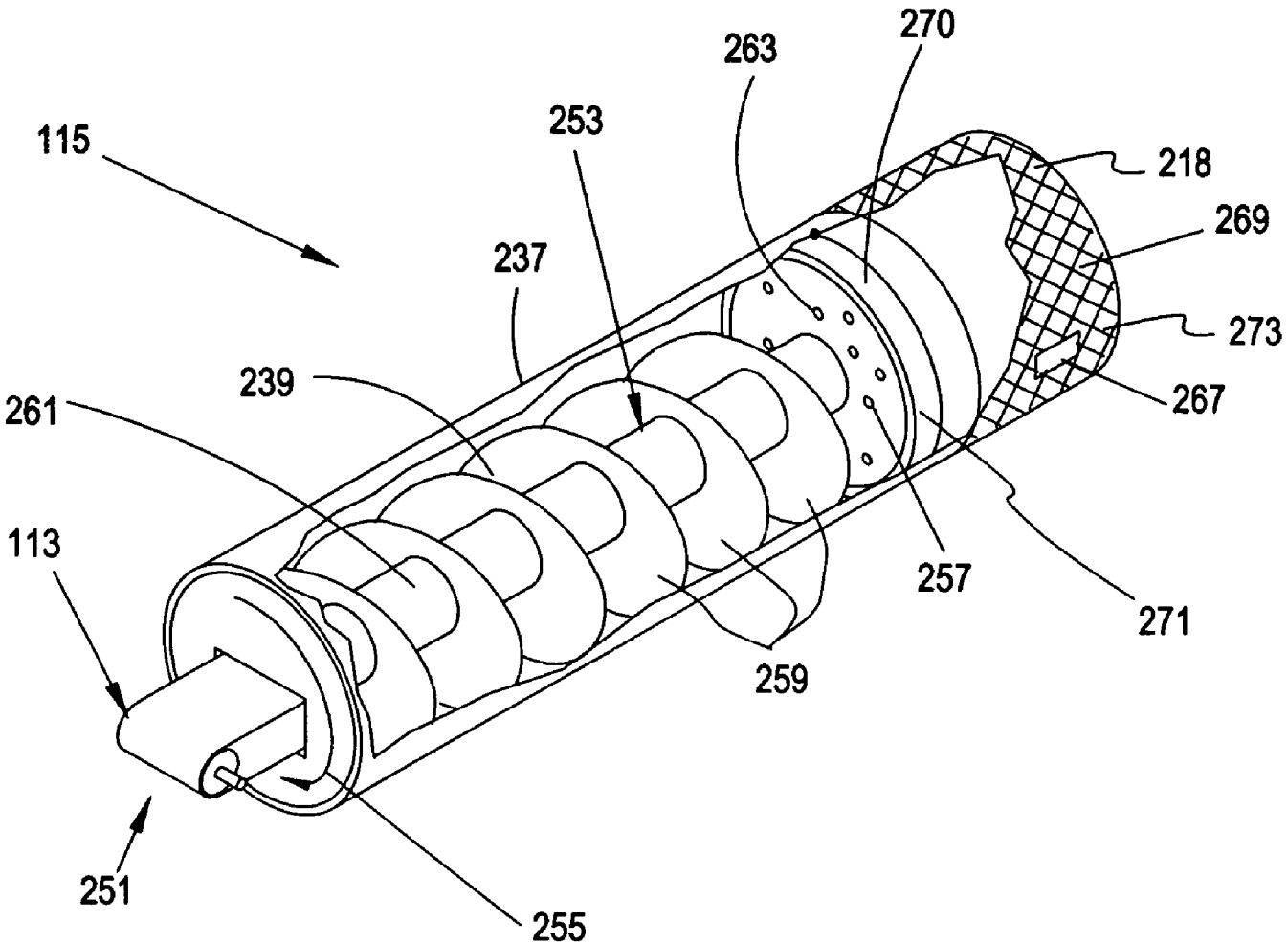
FIG. 2B Diagram of final processing element.

The fuel pulp is transported by second conveyor 113 to the proximal end 251 of the final processing unit 115 as diagrammed in FIG. 2B. The final processing unit 115 comprises a housing element 237 with an open core 239. A fuel pulp auger 253 driven by an independent motor (not illustrated) rotates the fuel pulp auger 253 (in a clock-wise direction, arrow 255, as illustrated) to press the fuel pulp through openings 263 a die plate 257 thereby forming unprocessed fuel, commonly in the form of wafers or pellets. Heavy auger blades 259 are attached to the auger central axle 261 to force the fuel pulp through openings 263 in the die plate 257. A blade device 270 traverses the distil face 271 of the die plate 257 to cut the extruded fuel pulp into unprocessed fuel (wafers or pellets) of a predetermined size, as one skilled in the art recognizes. The size and shape of the wafers or pellets are determined by characteristics of the openings 263 and frequency at which the extruded is cut by blade device 270.

The unprocessed fuel, in the form of wafers or pellets, when cut falls into a rotating drying drum 269. The wall material 273 of the rotating drum 269 is an open mesh screen to facilitate air movement and drying of the newly formed unprocessed fuel (wafers and pellets). Optionally, the rotating drum may include forced air fans and/or independent heating (not illustrated) to aid drying. The forced air may be heated, or the wall of the drum may be heated.

The dried, unprocessed fuel (fuel pellets) is discharged from the distil end 218 of the final processing unit 115 through a drum discharge gate 267 to a third conveyor 123 and conveyed to temporary storage 121.

From temporary storage, the unprocessed fuel is conveyed by closed auger 125 to fuel input unit 127 in the top of the single chamber, down-draft gasifier furnace 129. The single chamber, down-draft gasifier furnace comprises three major elements as illustrated in FIGS. 3A and 3B: a body element 301, a top closure element 317, and a funnel-shaped bottom element 329 with a spent fuel discharge gate 327. The single chamber, down-draft gasifier furnace 129 includes an outer shell, or outer casing 325 for insulation and non-technical, installation purposes, but otherwise, the casing 325 is not a critical, functional element of the single chamber, down-draft gasifier furnace 129 or system 101, and an inner shell 331 that defines many functional aspects of the gasifier furnace 129.

The structure and shape of the inner shell 331 describe and define an open inner core 302 of the single chamber, down-draft gasifier furnace 129. The overall length (height) 304 of the single chamber, down-draft gasifier furnace from its top 383 to its bottom 381 varies from six feet (2 m) or less to 24 feet (8M) or more, with a practical, but not limiting range of 6 to 12 feet (2 to 4 m).

The inner shell 331 comprises a single, open core 302, down-draft gasification chamber with a length 303. The inner shell 331 has an upper inner body 384 with a diameter 389 and a lower inner body 387 with a diameter 391. The diameter of the upper inner body 389 is less than the diameter of the lower inner body 391, such that the interface 323 of the upper inner body 384 and the lower inner body 387 forms a shoulder 328. When the gasifier furnace 129 is properly charged with charcoal and quantities of fuel input balance the removal of spent fuel (charcoal), in the open core of the inner body 302, the shoulder 328 causes the spent fuel 397 (FIG. 3C) to be distributed as illustrated, resulting in the formation of a fuel gas accumulation zone 319.

The height of the upper body 384 is defined in terms of its diameter 389; generally the height of the upper body is 1.5× the diameter. The height of the lower body (excluding the bottom element) is at least equal to its diameter 391 and should not exceed 1.5× the diameter 391.

The vertical profile of the single chamber, down-draft gasifier furnace 129 reflects significant details of its general structure, functions, and operation. FIG. 3B illustrates the stratification of the vertical profile of the open core 302 of the body element 301.

Stratification of the profile of the single chamber, down-draft gasifier furnace 129 is described in terms of the status of fuel material in each of three regions or layers (strata), and in turn, the vertical location and limits of individual layers or regions are determined by the temperature of the layer and by available oxygen throughout the layer. The lower-most layer 311 (FIG. 3C) comprises spent fuel, the middle layer is the pyrolysis region 307 in which the gasification zone 304 is formed as a distinct stratum. The upper-most layer 305 comprises unprocessed fuel. Controlled temperature and limited oxygen supply combine to allow the unprocessed fuel to be gasified, yielding fuel gas and the spent fuel (charcoal) as the product and by-products respectively.

Effectively, the stratification of the vertical profile (FIG. 3B) of the single chamber, down-draft gasifier furnace 129 comprises three thermal regions or layers, extending from the upper surface 314 of the upper-most layer 305 downward to the pyrolysis region 307 in which the critical gasification zone 309 is created as a distinct thermal stratum characterized with temperatures from 1470 F to 2790 F (800 C to 1200 C). Note also that the lower-most limit 308 of the gasification zone 309 is characterized as effectively entirely depleted of air.

The down-draft air movement controlled by air input pump 128 and the fact that the only discharge point for the fuel gas is via the fuel gas discharge pipe 315 that opens into the fuel gas accumulation zone 319, cause the fuel gas passes downward through a layer of still hot spent fuel starting at the lower limit of the pyrolysis region 320. Exposure to the hot spent fuel purifies the fuel gas removing volatile contaminates and other impurities.

FIG. 3B shows a variety possible positioning of monitoring and system control devices and instrumentation 321, including, but not limited to thermocouples, thermometers, fuel feed and air flow control.

To facilitate rapid, uniform ignition of the unprocessed fuel electrical or chemical igniters (not illustrated) are positioned in around the inner perimeter of the upper body 384 near the mid-point of the gasification zone 309 to ignite the fuel. As noted above, temperature, fuel gas sensors, other monitors and controls 321 are positioned are positioned from above the uppermost surface of layer of unprocessed fuel pellets 305 in the gasification zone 309 and near the base of the bottom element 322. In addition a fuel supply detector system 324A, B,C is positioned at the upper surface of the uppermost layer, layer of unprocessed fuel 305 such that, by photo-electric means, as the level of unprocessed fuel pellets drops (as a result of processing of fuel pellets and correlated removal of spent—processed—fuel, through the spent fuel discharge gate 327, the closed auger 125 is activated to deliver more unprocessed fuel to the uppermost layer 305, thereby maintaining uniform thickness of each of the three layers and the related control of temperature associated with depletion of air at the bottom edge of the gasification zone. Operation of the closed auger 125 and the spent fuel discharge gate 127 (and related waste removal means, not illustrated) are integrated with electrical means to ensure the balance of the input/outflow to and from the single chamber, down-draft gasifier furnace 129. When adequate fuel is available, the electric eye beam 324A generated by electric eye output 324B is blocked by the fuel and cannot be detected by detector 324C. When the fuel level drops, electric eye beam 324A is no longer blocked, and when detected by detector 324C, closed auger 125 is activated. Simultaneously, fuel discharge gate 327 is opened and spent fuel is removed.

The integrated biomass converter system 101, from the closed auger 125 to the fuel gas storage element 141 is a low-pressure, down-draft closed circulation system with controlled air input by controlled air input pump 128 and discharge from the single chamber, down-draft gasifier furnace 129 through fuel gas discharge pipe 131, thence through fuel gas cooler 133, the dryer 137, and to the fuel gas storage element. The down-draft and flow of fuel gas are directed by in-line pump 147 from the gasifier furnace 109 to the fuel gas storage element 141.

To ensure constant controlled air flow to the gasification zone, the thickness of the layer and related physical properties related to the loading of the unprocessed fuel in the upper most layer 305 are very important to effective operation of the single chamber, down-draft gasifier furnace 129. The thickness varies, depending on the size of the gasifier furnace from 3 to 10 inches (7.6 to 25.4 cm) with variation within any given gasifier furnace limited to plus or minus 20 (preferably 10) percent of the above average range. Ideally, the upper-most surface 314 of the upper-most layer 305 is smooth and free of lumps and clods of unprocessed fuel. The entire layer is ideally loose (uncompacted) or open to facilitate air movement through the layer. These conditions are maintained in part by balancing input of unprocessed fuel with the removal of spent fuel and by the function of the unprocessed fuel conditioner 345 (FIG. 3D and FIG. 3E). Although certain fine, particulate material can be introduced into the gasification process (FIGS. 3D, 3E, and 3F, surface treatment element 396), dust introduced with the unprocessed fuel material may settle in a layer on the top of the uppermost layer of unprocessed fuel 314 and disrupt the controlled, downward flow of air. To reduce this risk, a dust removal vacuum pump 125A is positioned near the junction of the closed auger 125 and fuel input unit 127. The vacuum pump is operated only when unprocessed fuel is being delivered to through the fuel input unit 127.

Successful operation of the single chamber, down-draft gasifier furnace 129 starts with loading the lower-most layer 311 with spent fuel (charcoal) to ensure a uniform base on which the pyrolysis region 307 and gasification zone 309 are formed. The loading pattern and related details are shown in FIG. 3C in which the interface 323 of the upper and lower body is illustrated, including the shoulder 328 with the lower portion of the upper body 324 and the upper portion of the lower body 384 included.

Proper loading, whenever charcoal (or spent fuel) must be added to the lower-most layer 311 is accomplished in two steps with the spent fuel loaded from the top 383 of the single chamber, down-draft gasifier furnace 129. In the first filling step, a quantity of spent fuel great enough to form a cone of material with its apex above the initial loading line 394 is loaded into the lower inner body 386. This cone is leveled such that the lower inner body 386 is completely filled to the initial fill line 394. In the second filling step, additional spent fuel is added forming a second cone with its apex above the final fill line 395. This cone is leveled such that the full diameter of the upper inner body is filled to the final fill line 395. As a result of the configuration of the first filling step and addition of spent fuel in the second filling step, a volume under the shoulder 328 is essentially void of charcoal thereby forming the fuel gas accumulation zone 329. Fuel gas produced from the gasification of the unprocessed fuel is discharged through the fuel gas discharge pipe 315. The first end 398 of the fuel discharge pipe 315 opens into the fuel gas accumulation zone 329. The fuel gas flows to the fuel gas accumulation zone 329 in response to the air pressure (down-draft flow) maintained in the gasifier furnace) and outward through the fuel gas discharge pipe 315. In addition, an in-line pump 147 also contributes to this directional flow. Instrumentation 321 to monitor the fuel gas and fuel gas flow and temperature is positioned in each fuel gas discharge pipe 315, and a control valve 326 regulates the flow and prevents back-flow of the fuel gas. The control valve 326 is functionally connected for automatic operation/control, including emergency shut-down of the single chamber, down-draft gasifier furnace 129.

Details of the top closure element 317 of the single chamber, down-draft gasifier furnace 129 are illustrated in FIGS. 3D and 3E. The top element 317 comprises a more-or-less dome-shaped cap piece 312 with a outer surface 314, an inner surface 318, and an apex 330. An opening is formed in the cap piece 312 at the apex 330 to which the distil end 376 of the fuel input unit 127 is attached. The closed auger 125 is adapted to being mechanical attached to the proximal end 377 of the fuel input unit 127. The fuel input unit 127 comprises a low pressure air lock 378 to inhibit creation of up-draft conditions in the gasified furnace. A rotating disc with baffles to distribute unprocessed fuel uniformly (not illustrated) may be positioned in the distil end 376 of the fuel input unit 127.

Closed auger 125 is removeably connected to the fuel input unit 127. The entire top closure element 317 is removeably attached to the upper body 384 at interface with the top closure unit 317. The connection forms a low pressure pneumatic seal to maintain the down-draft environment of the single chamber, down-draft gasifier furnace 129. Connection between the upper body 384 and top closure element 317 at the interface may be by individual locking lugs, bolts, locking rings, or other means, as one skilled in the art recognizes.

An air input pump 128 (FIG. 3D) is positioned to deliver a controlled flow of air into the open core of the inner body 302. The pump 128 functions in coordination with instrumentation and controls 321 associated with pyrolysis region 307 and gasification zone 309 in the single chamber, down-draft gasifier furnace 129 as well with removal of spent fuel and introduction of unprocessed fuel material.

In addition to supporting air input pump 333, the fuel input unit 127, and the exhaust discharge element 143, the top closure element 317 supports a primary unprocessed fuel distribution element 350, and also provides support through the support and distribution sphere 355 to the central axle rotational and vertical travel system 345. The primary fuel distribution element 350 comprises a support and distribution sphere 355 that is centered in the cap piece 312 by rigid support rods 347 anchored to the sphere 355 and to the interior face of the cap piece inner surface 318. A steel central axle 349 with a hollow core 353 traverses the sphere 355 and moves freely vertically while being snugly supported by the sphere 355. A rotatable, air-tight fitting 348 connects the distil end 352 of the central axle 349 to the central axle slightly below the entry of the supplemental fuel and gas supply pipe 371 adapted to introduce supplemental fuel gasses and combustible particulate matter.

The diameter 354 of the sphere 355 (FIG. 3E) and the outside diameter of the central axle 349 and the diameter of the open core of the central axle 353 are not critical. The diameter 354 of the sphere 355 is in practice a function of the size of the cap piece 312 and may range from 6 inches to over 24 inches (12 cm to 60 cm). The outside diameter of the central axle varies from about 0.75 inch to 4 inches (2 cm to 10 cm), but none of the above dimensions constitutes fixed limits.

The central axle rotational and vertical travel system 345 described below provides the necessary structural support for gears to rotate the central axle 349 and to raise and/or lower it. Platform supports 365 provide the basic support for the rotational and travel system. The platform supports 365 are attached to the sphere 355, commonly by being threaded into the sphere. The platform supports 365 are positioned opposite each other and descend vertically parallel to the central axle 349. The platform supports 365 traverse and support a first platform 357 and a second platform 359. Pairs of locking nuts 392 installed on the top and on the bottom of first platform 357 and the second platform 359 hold the first platform and the second platform in position vertically on the platform supports, FIG. 3E.

A first length of the central axis comprises the vertical travel gear 366 with a length 360. A motor unit and gear comprising the elevator gear part 363 are mounted on the second platform such that a travel gear element 363A engages the vertical travel gear 366 and can thereby raise and lower the vertical axis. The travel gear element 363A can be moved to disengage it from the vertical travel gear 366.

In a similar manner, a second length 358 of the central axle 349 comprises the rotational gear 364. A second motor unit and gear comprising the rotational gear part 362 are mounted on the first platform 357 such that a rotational gear element 362A engages the rotational gear 364 at some point along its length 358 thereby rotating the central axis. The rotational gear element a can be moved to disengage it from the rotational gear 364.

A surface treatment element 396 is connected to the distil end 382 of the central axle 349. The surface treatment element 396 comprises a boot support 369 with a open central core 368 with closed ends 368A. As shown in FIG. 3F, the central axle 349 is connected to the mid-point of the boot support 369 such that the hollow central core 353 of the central axle 349 opens into the hollow central core 368 of the boot support 369. A plurality of gas injection boots 367 are connected to and descend vertically from the boot support 369. Each gas injection boot 367 comprises a vertically descending boot shank 370 with a hollow central core 336. The boot shank 370 is attached at one end to the boot support 369 such that the hollow central core 368 of the boot support 369 open to the hollow core 336 of the boot shank 370. At the opposite end, the boot shank 370 is connected to a shoe 372. The shoe 372 comprises an open core 375, a proximal/discharge end 374, and a distil end 373. The shoe 372 is attached to the boot shank 370 such that the open core 336 opens directly to the open core 375 of the shoe 372.

The surface treatment element 396 further comprises a plurality of pressure wheels 361 supported by and rotating on an axle 398 and supported by a frame 399 are attached by a support arm 397 at right angle to and on the lower center of the boot support 369. In an alternative mode, the pressure wheels 361 and support arm may be attached to the upper surface of the boot support 369.

By action of the vertical travel gear 366, the shoes can be pressed below the surface of unprocessed fuel material (the upper most layer) 305. Gasifiable particulate matter, oxygen, combustible gasses, or other gasifiable material can be introduced to the upper most layer through the supplemental fuel and gas supply pipe 371 that contacts the open core 353 of the central axis with open communication to the shoes 372 to discharge the material into the upper-most layer 305 uniformly. Rotation of the central axis by the rotational gear 364 serves to distribute material uniformly, and the press wheels serve to smooth the surface of the upper most layer 305 and maintaining a uniformly thick, level layer of unprocessed fuel material.

To minimize the discharge of air pollutants associated with any "cold" start-up of the single chamber, down-draft gasifier furnace 129, a start-up, exhaust discharge vent 143 is positioned on the cap piece 312. The exhaust may optionally be positioned in-line in the first fuel discharge pipe 131 the second fuel discharge pipe 135, the dryer discharge pipe 145, or the final discharge pipe 149. Functionally, the exhaust discharge vent 143 is the same regardless of location in the system 101, as one skilled in the art recognizes; thus, it is described and explained only for positioning on the cap piece 312.

The exhaust discharge vent 143 described in FIG. 3D is positioned on the cap piece 312. A series of high temperature burners 337 is positioned longitudinally along a portion of the interior of the exhaust discharge vent 343. A particulate matter detector 340 and a first discharge control butterfly valve 151 are positioned at the distil end 170 of the exhaust discharge vent 143.

With the exhaust discharge vent 143 positioned on the piece cap 312, a second control butterfly valve 155 is positioned in-line in the first fuel discharge pipe 131.

A particulate matter, exhaust recovery loop 339 is connected to the exhaust discharge vent 143 below the particulate matter detector 340 and above the proximal end 115 of the exhaust discharge vent 143.

The gasification process produces minimal quantities of by-product air pollutants. The process generally operates at temperatures in the gasification zone 309 in the range of 800 C to 1800 C. At start-up, until operating temperatures in the gasification zone approach 800 C, the system unavoidably produces exhaust particulate matter. Discharge of this exhaust particulate matter is minimized by operation of the exhaust discharge vent 143.

Operation of the first butterfly valve 151 and the second butterfly valve 155 is controlled by heat sensor/controls located in the single chamber, down-draft gasifier furnace 129. At temperatures below 800 C in the pyrolysis region 309, the second butterfly valve 155 is closed and initially the first butterfly valve 151 is open. Exhaust particulate must pass upwards, through the exhaust discharge vent 143 where it is exposed to vaporizing heat generated by the high temperature burners 337. The heat treated exhaust particulate passes upward through the particulate matter detector 340. If the level of particulate matter in the exhaust is acceptably low, the exhaust is discharged into the atmosphere. If the level is unacceptably high, the first butterfly valve 151 is automatically closed, and the exhaust material moved downward, through the recycle loop 139 to be passed through the burners a second time; if, when the exhaust passes the particulate matter detector the level is acceptable, the first butterfly valve is opened, and the exhaust discharged into the atmosphere; else wise, the cycle is repeated. When the temperature in the gasifier exceeds 800 C (or any other specified level), particulate matter is generally destroyed in the gasification process. At this or any other specified temperature, the first butterfly valve 151 is closed and all products from the gasifier pass through system as described above.

Heated, relatively hot (800 C or higher) fuel gas flows via first fuel discharge pipe 131 from the gasifier furnace 129 to the fuel gas cooler 133. The fuel gas cooler 133 comprises a fuel gas tank 401 a coolant fluid heat exchanger 403. Coolant fluid is cycled from the fuel gas tank through the heat exchanger and back to the fuel gas tank as follows. Coolant fluid is discharged from the tank by first coolant pipe 405. In-line coolant fluid pump 407 moves coolant fluid to heat exchanger 403 as indicated by arrow 409. Coolant fluid cycles through heat exchanger 403 which includes heat exchanger fan 411 that serves to increase cooling efficiency of heat exchanger 403, and coolant fluid re-enters coolant fluid tank 401 via coolant fluid discharge 413.

The flow of the hot fuel gas is indicated by arrow 423. Hot fuel gas is transported to the fuel gas cooler 133 by first fuel discharge pipe 131. The heated fuel gas is feed to a bubbler 417 by fuel gas feed 415. The bubbler 417 is positioned on or very near the bottom of the coolant tank 401. Functionally, the hot fuel gas in forced through a series of openings in the bubbler and bubbled through the coolant fluid. The coolant fluid may be, but is not limited to, diesel fuel, vegetable oil, other liquid petroleum materials, liquid organic compounds, and water. The hot gas is cooled by bubbling through the coolant fluid; the hot fuel gas rises in the tank and is discharged through second fuel discharge pipe 135. The direction of flow of fuel gas is indicated by arrow 423. An cooler in-line pump 421 provides the pressure gradient to move the cooled fuel gas to the dryer 137. The cooling process increases the moisture content of the fuel gas and necessitates drying the fuel gas. The fuel gas is conveyed from the cooler to the dryer by the second fuel discharge pipe 135.

Figure 5:
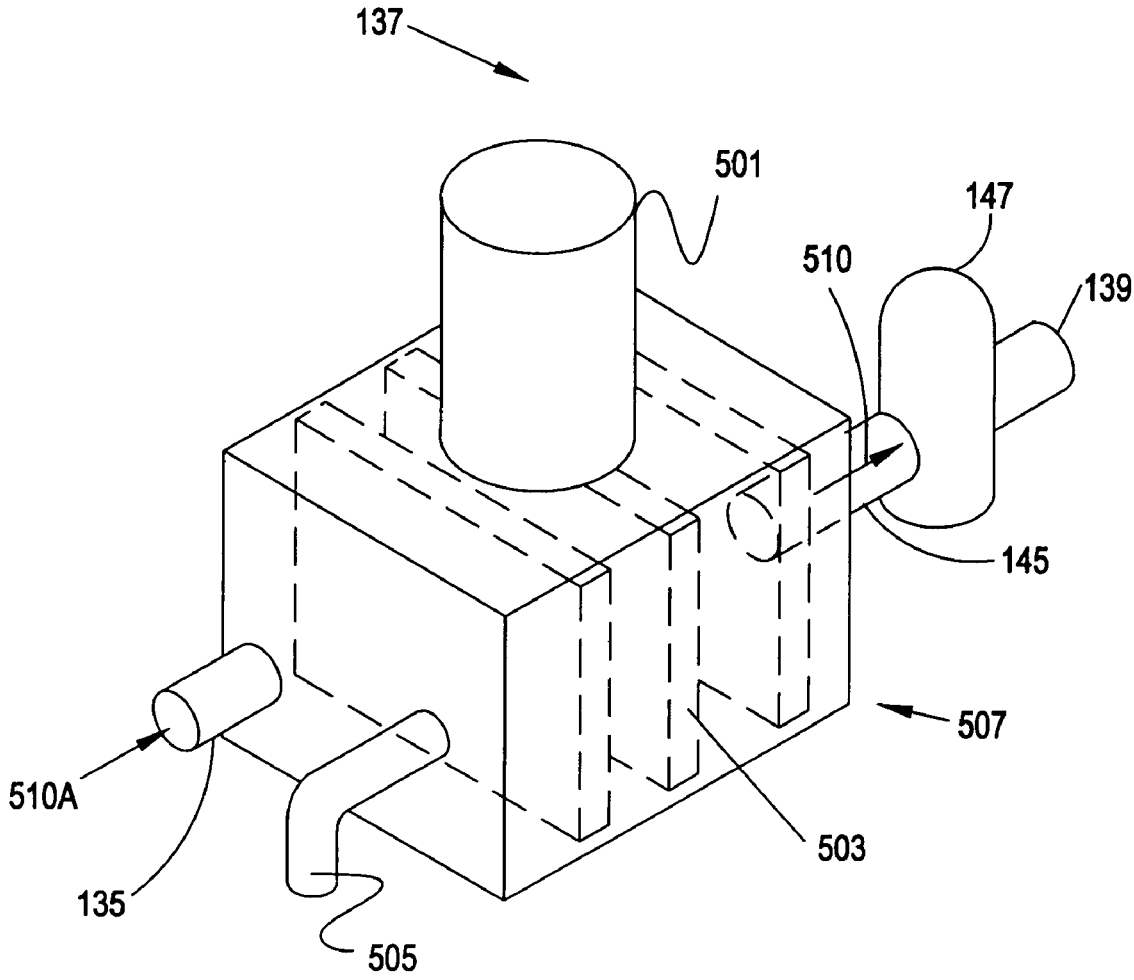
FIG. 5 Diagram of fuel gas dryer.
Figure 6:
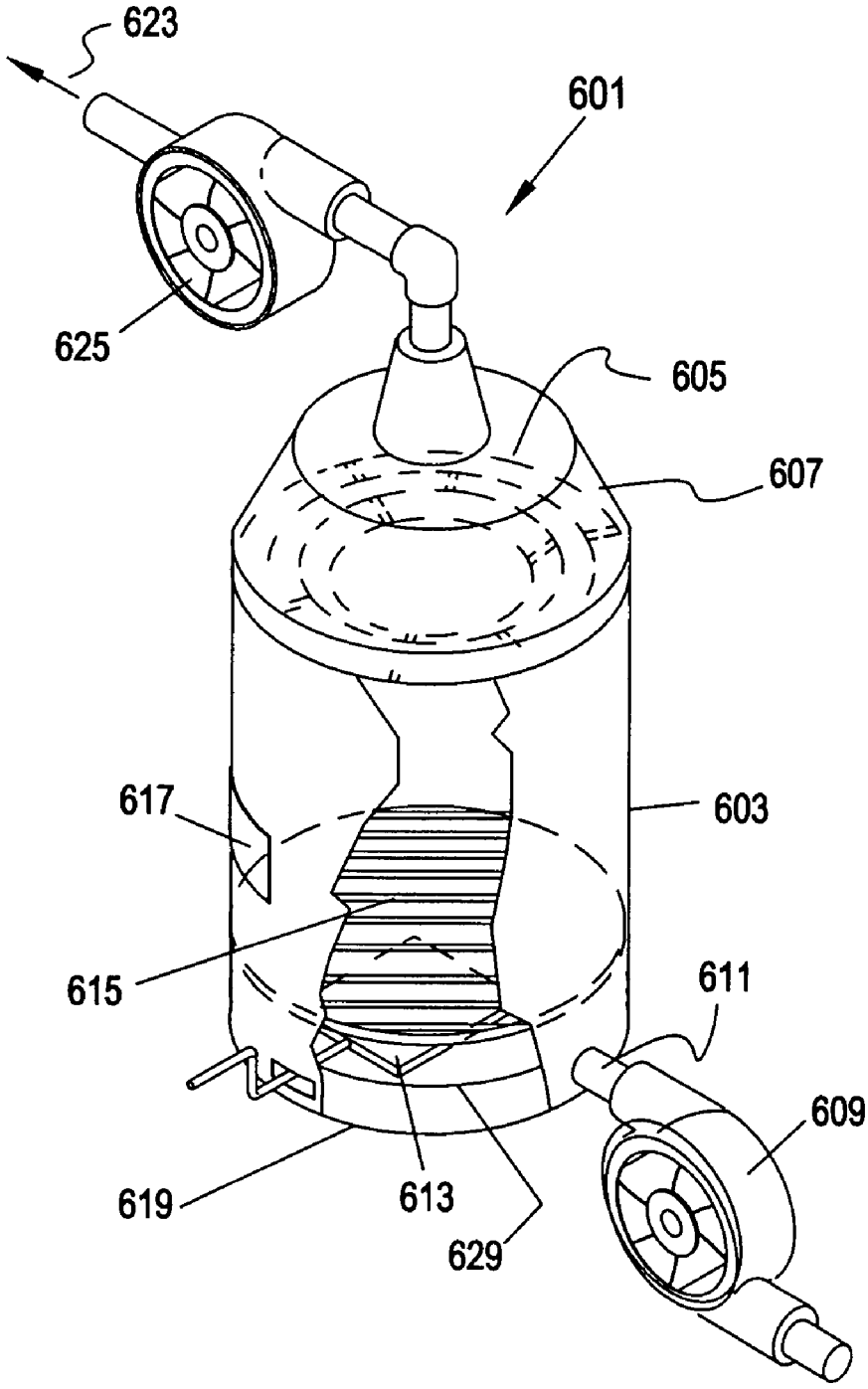
FIG. 6 Diagram of incinerator unit for particulate matter production.

The dryer 137, as one skilled in the art recognizes, may be any of a variety of commercially available dehumider (or similar) devices. As illustrated in FIG. 5, the direction of flow of the fuel gas is indicated by arrow 510A by the second discharge pipe 135 into the dryer 137. The dryer 137 comprises a compressor functionly connected to cooling/condensation plates or tubes 503. The cooling/condensation plates or tubes are positioned in the dryer housing 507. Condensate is discharged through condensation drain 505. The relatively moist fuel gas enters the dryer housing 507 as described above. It contacts the cooling/condensation plates or tubes on the surface of which moisture accumulates to ultimately be discharged as condensate through condensate drain 505. The dried fuel gas flows in the direction of arrow 510 and is discharged through the dryer discharge pipe 145. In-line dryer discharge pump 147 generates the pressure gradient for flow of the fuel gas through in-line pump 147 to the final gas discharge pipe 139.*n*

FIG. 1 does not include means to produce the particulate matter that could be introduced to the either as fuel or as directly gasifiable material injected by means of the surface treatment element 396. The invention anticipates a solid waste incinerator that is fully integrated with the gasifier furnace and chain of supply of fuel material for gasification.

The solid waste incinerator 601 comprises a body 603 and a heat exchanger 605 through which heat generated in the process of producing gasifiable particles, heat generated may be captured and used.

The incinerator is a up-draft device with the upper portion of the interior of the body being a zone of accumulation of fine particulate matter produced from incomplete combustion of certain biomass and other organic materials, including rubber from used tires. Regulated air in-put flow is achieved by air input pump 609 with air delivered by input pipe 611. A combustion igniter 613 is positioned at the base of the incinerator to ignite the fuel material. A support grid 615 holds fuel off the floor of the incinerator and ensures better ar circulation, hence better control of the incineration process. Fuel is fed into the incinerator thorough door 617. It should be noted that fuel could be loaded by mechanical means, such as a variety of conveyors, or by manual effort.

The floor of the incinerator 629 is level; a sloped subfloor 619 provides space for the accumulation of charcoal and partially combusted materials.

Particulate matter produced from incomplete combustion is removed from the incinerator via particulate discharge pipe 627. Direction of flow is indicated by arrow 623. On-line incinerator fan or discharge pump provides gradient to move fine particulate matter to selected mode of entry into gasification process.

The preceding illustrations, descriptions, and examples are exemplary in nature and not limitations. As one skilled in the art recognizes, numerous parts and elements can be interchanged or mixed to yield additional examples all of which are within the scope of the invention and anticipated by the appended claims; thus the claims should be afforded the broad construction anticipated by the preceding disclosure.

What is claimed is:

1. An integrated biomass converter system comprising:

an initial separating and processing element;

a final processing element;

a single chamber, down-draft, gasifier furnace; a cooler; and a dryer;

said integrated biomass converter system further comprising:

an initial storage unit; a temporary storage unit; and a final storage unit;

wherein said initial storage unit is in mechanical and functional communication with said initial separating and processing unit by a first conveyer by which biomass is conveyed from said initial storage unit to said initial separating and processing unit, and said initial separating and processing unit converts said biomass to fuel pulp; further wherein said initial separating and processing unit is in physical and functional communication with said final processing unit by a second conveyor, and wherein said final processing unit converts said fuel pulp into unprocessed fuel; further wherein said final processing unit is in physical and functional communication with said temporary storage unit by a third conveyor, and said temporary storage is in functional communication with said single chamber, down-draft, gasifier furnace by a closed auger adapted to deliver unprocessed fuel to a fuel input unit positioned on the cap piece of the top closure element of said single chamber, down-draft, gasifier furnace; and further wherein an input air pump is positioned on said cap piece and controls air input to said gasifier furnace to maintain a down-draft air flow; and further, wherein fuel gas produced by gasification of said unprocessed fuel is conveyed from said gasifier furnace to said cooler by a first fuel gas discharge pipe, and further wherein said fuel gas is conveyed from said cooler to said dryer by a second fuel gas discharge pipe, and still further wherein said fuel gas is conveyed from said dryer to said final storage unit by a final fuel gas discharge pipe; and further wherein said top closure element of single chamber, down-draft, gasifier furnace comprises a primary fuel distribution and support sphere, wherein said support sphere is connected to and centered in the interior of said cap piece by rigid support rods; a central axle with a hollow core traverses said primary fuel distribution and support sphere and platform supports anchored in said primary fuel distribution and support sphere descend vertically from it; said top closure element of said single chamber, down-draft, gasifier furnace further comprises the central axle rotational and vertical travel system; the central axle rotational and vertical travel system comprises a first platform and a second platform wherein said first platform and said second platform are positioned on and secured to said platform supports; rotational gear elements are positioned on said first platform and formed in an adjacent length of said central axle; and vertical travel elements are positioned on said second platform and formed in an adjacent length of said central axle; said top closure element further comprises a surface treatment element structurally and functionally connected to the distil end of said central axle, wherein said surface treatment element comprises boot support in fluid communication with the open core of said central axle, wherein a plurality of gas injection boots are connected to and in fluid communication with said boot support, and each gas injection boot comprises a boot shank and a shoe with an open, discharge end; fluid communication exists from the hollow core of said shoe through said hollow core of said central axle to the supplemental fuel and gas supply pipe at the proximal end of said central axle; said surface treatment element further comprise a plurality of pressure wheels and an axle and support frame connected near said distil end of said central axle, wherein said pressure wheels are adapted to condition the surface of unprocessed fuel in said single chamber, down-draft, gasification furnace.

2. The integrated biomass converter system of claim 1 wherein said integrated biomass converter system further comprises an incinerator capable of producing gasifiable particulate matter, and wherein said incinerator is functionally connected to and in operational communication with a supplemental fuel input point on said cap piece of said top closure element of said gasifier furnace.

3. The integrated biomass converter system of claim 1 wherein said final processing unit comprises a chopper element wherein supplemental fuel and gasifiable particulate matter can be introduced to fuel pulp by a supplementary fuel material delivery pipe.

4. The integrated biomass converter system of claim 1 wherein supplemental fuel material and combustible gasses can be introduced to the gasification zone of said gasifier furnace through the supplemental fuel input pipe.

5. The integrated biomass converter system of claim 1 wherein a vacuum is positioned to remove dust from unprocessed fuel delivered to said single chamber, down-draft gasifier furnace.

6. The integrated biomass converter system of claim 1 wherein an air pump to generate a down-draft air and gas flow is positioned on the top closure element of said single chamber, down-draft gasifier furnace and one or more additional air pumps are positioned in gas out-put pipes to maintain the air pressure gradient.

7. A single chamber down-draft gasifier furnace comprising a cap piece wherein said cap piece comprises an unprocessed fuel management element, wherein said unprocessed management element comprises a primary unprocessed fuel distribution element and a surface treatment element, wherein said primary unprocessed fuel distribution element comprises a support and distribution sphere wherein said support and distribution sphere is securely positioned by rigid support rods, in the interior of said cap piece directly below a fuel input unit; and further wherein said surface treatment element comprises a central axle said central axle having an open core, a distil end, and a proximal end; and further wherein said central axle vertically traverses said support and distribution sphere, and still further wherein a combustible gas and fuel supply pipe is functionally connected near the proximal end to said central axle such that said open core of said central axle is in fluid communication with said gas and fuel supply pipe; and still further wherein a first length of said central axle comprises the rotational gear and a second length of said central axle comprises the vertical travel gear; and further wherein said surface treatment element comprises a rotational gear part and a vertical travel gear part, and wherein said vertical travel gear part is positioned as part of the vertical travel gear unit on a first platform and said rotational gear part is positioned as part of a rotational gear unit on said second platform; further wherein platform supports descend vertically from said support and distribution sphere wherein said platform supports are anchored to said support and distribution sphere, and further wherein said first platform and said second platform are independently positioned on and securely attached to said platform supports such that said rotational gear part releaseably engages said rotational gear and said vertical travel gear part releasably engages said vertical travel gear, and further wherein said central axle traverses said first platform and said second platform; said surface treatment element further comprises an injection system and a leveling/pressure-wheel-roller system; wherein said injection system comprises a bock support with an open core, a plurality of boot shanks, attached to and descending vertically from said boot support, each of said plurality of said boot shanks comprising a gas injection boot with do open core and a shoe with an open core, said shoe further comprising a closed distil end and an open proximal/discharge end; further wherein said boot support is securely attached to said distil end of said central axle such that the open core of said central axle is in fluid communication with said open core of said boot support, and further wherein the open core of each of said injection boots is in fluid communication with the open core of said boot support, and further wherein said open core of each of said injection boots is in fluid communication with said open core of said shoe to which it is connected as a part of one of said plurality of boot shanks, such that material introduced into said gas and combustible fuel supply pipe is discharged into the surface of unprocessed fuel in the upper most layer of the said gasifier furnace from the distil/discharge end of said shoe; and further said surface treatment element comprises a leveling/pressure-wheel-roller system, wherein said leveling/pressure-wheel-roller system comprises a frame securely attached to near the distil end of said central axle and an axle connected to said frame, wherein a plurality of pressure-wheels-rollers are rotatably positioned on and supported by said axle and further wherein said pressure-wheels-rollers contact said upper surface of unprocessed fuel in the uppermost layer of said gasifier furnace and smooth and level said uppermost layer in response to rotation and vertical travel of said central axle.

* * * * *